US005458764A

United States Patent [19]

Urakawa et al.

[11] Patent Number: 5,458,764

[45] Date of Patent: Oct. 17, 1995

[54] METHOD OF MANUFACTURING PLATED STEEL SHEET WITH ZN-CR ALLOY PLATING

[75] Inventors: Takayuki Urakawa; Satoru Ando; Toyofumi Watanabe, all of Tokyo, Japan

[73] Assignee: NKK Corporation, Tokyo, Japan

[21] Appl. No.: 188,212

[22] Filed: Jan. 27, 1994

[30] Foreign Application Priority Data

Aug. 10, 1993 [JP] Japan ..... 5-198342
Aug. 27, 1993 [JP] Japan ..... 5-212734

[51] Int. Cl.[6] ..... C25D 3/22; C25D 3/06; C25D 3/10

[52] U.S. Cl. ..... 205/155; 205/156; 205/243; 205/244

[58] Field of Search ..... 205/155, 156, 205/243, 244, 287, 290

[56] References Cited

U.S. PATENT DOCUMENTS 4,597,838 7/1986 Bammel ..... 204/44.2
4,898,652 2/1990 Bammel et al. ..... 204/44.2

FOREIGN PATENT DOCUMENTS 0285931 3/1988 European Pat. Off. .
285931 10/1988 European Pat. Off. .
0566121 10/1993 European Pat. Off. .
63-243295 10/1988 Japan .
64-55398 3/1989 Japan .
64-55397 3/1989 Japan .
64-79393 3/1989 Japan .
1-162794 6/1989 Japan .
3-120393 5/1991 Japan .

*Primary Examiner*—John Niebling
*Assistant Examiner*—Edna Wong
*Attorney, Agent, or Firm*—Frishauf, Holtz, Goodman, Langer & Chick

[57] ABSTRACT

There is disclosed a method of manufacturing a plated steel sheet with a Zn—Cr alloy plating, including the steps of preparing a plating bath having a pH of 1 to 3 by adding 50 to 250 g/l of ammonium sulfate to a sulfuric acid plating bath and forming a Zn—Cr alloy plating film on a steel sheet using the resultant plating bath.

2 Claims, 3 Drawing Sheets

METHOD OF MANUFACTURING PLATED STEEL SHEET WITH ZN-CR ALLOY PLATING

BACKGROUND OF THE INVENTION

1. Field of the Invention

The present invention relates to a method of manufacturing a plated steel sheet with a Zn—Cr alloy plating which is excellent in adhesion properties.

2. Description of the Related Art

Zinc plating has sacrificing corrosion protecting property for steel sheets. The sacrificing corrosion protecting property is exhibited under environments in a variety of applications. Zinc-plated steel sheets have been used in various fields of automobiles, home appliances, and construction materials as major application fields of steel sheets.

In recent years, however, strong demand has arisen for further improving the corrosion resistance property of zinc-plated steel sheets, and particularly, electrical zinc-plated steel sheets mainly in the field of automobiles. To meet this demand, a steel sheet with a zinc alloy plating of, e.g., Zn—Ni or Zn—Fe has been developed, and its production quantity has been increasing. This steel sheet has become a major one of all steel products.

Attempts have been made to improve the properties of steel sheets with zinc alloy platings. In particular, it is reported that the corrosion resistance property of steel sheet with Zn—Cr alloy plating is excellent (Jpn. Pat. Appln. KOKAI Publication Nos. 63-243295 and 1-162794). There are also proposed methods of manufacturing steel sheet with Zn—Cr alloy plating (Jpn. Pat. Appln. KOKAI Publication Nos. 64-79393, 3-120393, and 64-55398).

Electrical zinc-plated steel sheets (including plated steel sheets with its various alloys) are generally manufactured using an acidic plating bath such as a sulfuric acid bath or a hydrochloric acid bath. In the manufacture of a plated steel sheet with a Zn—Cr alloy plating, this plated steel sheet cannot be obtained if chromium ions are simply added to such an acidic plating bath.

According to Jpn. Pat. Appln. KOKAI Publication No. 1-79393, it is described that Zn—Cr plating can be performed in a plating bath containing only zinc and chromium ions (partially including inorganic salts) at a high current density of 150 A/dm$^2$ or more. Inspite of this, at present, electrical zinc platings (including zinc alloy platings) are generally manufactured at a current density of 50 to 150 A/dm$^2$, and it is difficult to apply a high current density of 150 A/dm$^2$ or more in practice. Moreover, in plating at a high current density, diffusion of metal ions subjected to plating cannot generally follow up the plating rate. The hydrogen ions are subjected to a reducing reaction instead, and the pH of a portion near the plated surface is increased by this reducing reaction to produce and precipitate a hydroxide of the metal ions, thereby forming a black plating film having poor adhesion properties. This phenomenon produces so-called burnt deposits. This state degrades the plating adhesion property, and a practical plating film cannot be obtained. In fact, according to an examination of the present inventors, when plating was performed in a plating bath containing only zinc and chromium ions at a current density of 150 A/dm$^2$ or more, a plating burnt deposit was formed to fail to obtain a practical plating film although chromium was contained in the plating film.

According to Jpn. Pat. Appln. KOKAI Publication No. 3-120393, it is decribed that plating using a Zn—Cr alloy can be performed by adding a tartrate in a sulfuric acid bath containing zinc and chromium ions as major components. According to an examination of the present inventors, however, even if a tartrate was added to the sulfuric acid bath, chromium hardly coprecipitated, and a Zn—Cr plating film was not obtained.

According to Jpn. Pat. Appln. KOKAI Publication No. 64-55398, it is described that plating using a Zn—Cr alloy can be performed by adding a polyoxyalkylene derivative. According to an examination of the present inventors, polyethylene glycol as a kind of polyoxyalkylene derivative was added to obtain a Zn—Cr plating film. However, the plating adhesion properties were degraded with an increase in Cr content. In particular, when the Cr content was 15% or more, the plating adhesion properties were greatly degraded to fail to obtain a practical plating film.

As described above, according to the conventional plating methods using Zn—Cr alloy plating, it is difficult to obtain Zn—Cr plating films having excellent adhesion properties at a high Cr content.

SUMMARY OF THE INVENTION

It is an object of the present invention to provide a method of manufacturing a plated steel sheet with a Zn—Cr alloy plating, which is capable of obtaining excellent adhesion properties of the plating at a high Cr content.

According to the first aspect of the present invention, there is provided a method of manufacturing a plated steel sheet with a Zn—Cr alloy plating, comprising the steps of preparing a plating bath having a pH of 1 to 3 by adding 50 to 250 g/l of ammonium sulfate to a sulfuric acid plating bath, and forming a Zn—Cr alloy plating film on a steel sheet using the resultant plating bath.

According to the second aspect of the present invention, there is provided a method of manufacturing a plated steel sheet with a Zn—Cr alloy plating, comprising the steps of preparing a plating bath having a pH of 1 to 3 by adding, to a sulfuric acid plating bath, not less than 0.1 g/l of a polyoxyalkylene derivative and ammonium sulfate in an amount represented by the following formula, and forming a Zn—Cr alloy plating film on a steel sheet using the resultant plating bath:

Addition Amount of Ammonium Sulfate $$(g/l) \geqq (Cr\% + M\% - 15) \times 10$$

where Cr% is a Cr content (wt %) in the plating film and M% is a content (wt %) of a metal except for Zn and Cr in the plating film.

Examples of the Zn—Cr alloy are Zn—Cr, Zn—Fe—Cr, Zn—Ni—Cr, and Zn—Co—Cr alloys, and alloys obtained by adding Mo to the alloys.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
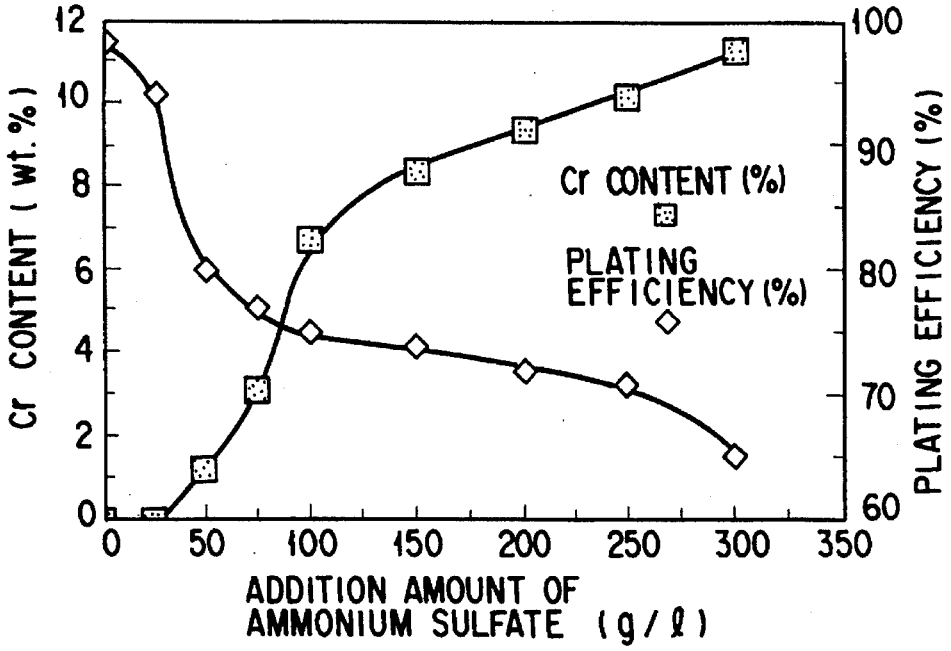
FIG. 1 is a graph showing the relationship between the addition amount of ammonium sulfate and the Cr content in the plating film, and between the addition amount of ammonium sulfate and the plating efficiency.

According to the first embodiment of the present invention, 50 to 250 g/l of ammonium sulfate are added to a sulfuric acid plating bath to prepare a plating bath having a pH of 1 to 3 and form a Zn—Cr alloy film on a steel sheet using the resultant plating bath, thereby obtaining a plated steel sheet with a Zn—Cr alloy plating excellent in adhesion property.

The present inventors made studies on a method of forming a Zn—Cr alloy plating excellent in plating adhesion property at a high Cr content and found that a Zn—Cr plating film having excellent adhesion property was formed by adding an appropriate amount of ammonium sulfate in a sulfuric acid plating bath containing zinc and chromium ions. The above constitution was obtained based on this finding.

Although prior arts using ammonium sulfate as a plating additive to aim at increasing the conductivity of a plating solution and stabilizing the outer appearance are found, the Cr coprecipitation effect of ammonium sulfate cannot be anticipated from the prior arts but is found by the present inventors for the first time. In this sense, the method of this embodiment is a novel as a method of manufacturing a plated steel sheet with a Zn—Cr alloy plating, which cannot be anticipated from the prior arts.

A mechanism which allows ammonium sulfate to form a Zn—Cr plating film, i.e., a mechanism of coprecipitating Cr is not yet clarified. However, the following two mechanisms can be assumed to clarify the Cr precipitation effect. First, an increase in pH on the surface is suppressed due to pH buffering of ammonium sulfate, and production of $Cr(OH)_3$ which is hard to reduce is suppressed. Second, ammonium ions are combined with a chromium hydroxide produced on the surface to facilitate reduction of the hydroxide.

The amount of ammonium sulfate added to the bath is defined to fall within the range of 50 to 250 g/l. If the addition amount is less than 50 g/l, the effect of coprecipitating Cr is not sufficiently enhanced, and a high Cr content cannot be obtained. On the other hand, if the addition amount exceeds 250 g/l, precipitation occurs to greatly degrade the plating efficiency.

Zn—Cr plating is performed using a sulfuric acid plating bath. The sulfuric acid bath is stable, has good electrical conductivity, and allows the use of an insoluble anode. The plating bath composition can be easily controlled, and the sulfuric acid plating bath is, therefore, suitable for the manufacture of an electrical zinc-plated steel sheet. The pH of this bath is defined to fall within the range of 1 to 3. If the pH is less than 1, the plating efficiency is poor to result in a small Cr coprecipitation amount. However, if the pH exceeds 3, Cr hydroxide precipitates. The Cr coprecipitation amount increases at a higher current density. Cr coprecipitation can be performed at a general current density of 50 to 150 $A/dm^2$.

Examples of the Zn—Cr alloy are Zn—Cr, Zn—Fe—Cr, Zn—Ni—Cr, and Zn—Co—Cr alloys, and alloys obtained adding Mo to the alloys.

According to the second embodiment of the present invention, a plating bath having a pH of 1 to 3 is obtained by adding, to a sulfuric acid plating bath, 0.1 g/l or more of a polyoxyalkylene derivative and ammonium sulfate in an amount represented by the following formula, and a Zn—Cr alloy plating film is formed on a steel sheet using the resultant plating bath, thereby obtaining a plated steel sheet with the Zn—Cr alloy plating excellent in adhesion properties:

Addition Amount of Ammonium Sulfate $$(g/l) \geqq (Cr\% + M\% - 15) \times 10$$

where Cr% is the Cr content (wt %) in the plating film and M% is the content (wt %) of a metal except for Zn and Cr in the plating film.

The present inventors made studies on a method of forming a Zn—Cr alloy plating excellent in adhesion property at a high Cr content and found that a Zn—Cr plating film having excellent adhesion property was formed by adding appropriate amounts of a polyoxyalkylene derivative and ammonium sulfate in a sulfuric acid plating bath containing zinc and chromium ions. The above constitution was obtained based on this finding.

A polyoxyalkylene derivative has an effect of increasing the Cr coprecipitation rate upon addition in a very small amount. However, when the Cr content increases, the plating adhesion property are degraded. In particular, this degradation typically occurs in a Zn—Cr-iron group metal (Fe, Ni, or Co) alloy.

On the other hand, the present inventors found that ammonium sulfate could be added to increase the Cr content of the Zn—Cr alloy to a practical level while the plating adhesion property were not degraded. However, the increasing effect of the Cr coprecipitation rate obtained by adding ammonium sulfate is less than that obtained by adding a polyoxyalkylene derivative, and the necessary addition amount of ammonium sulfate is high. Moreover, the chromium ion concentration in the plating bath must be high, resulting in inconvenience.

According to the second embodiment, both the polyoxyalkylene derivative and ammonium sulfate are added to obtain a high Cr content and excellent plating adhesion properties with a small addition amount of additives.

Of the above additives, the polyoxyalkylene derivative has a function of increasing the Cr content in the plating film, and ammonium sulfate has a function of improving the plating adhesion property.

Since the polyoxyalkylene derivative can cause Cr coprecipitation in a very small amount, this derivative is adsorbed in the surface of a steel sheet to promote reduction of Cr ions or Cr hydroxide into metal Cr. The improvement of the plating adhesion properties which is the main effect of ammonium sulfate is assumed to be obtained since the amount of Cr hydroxide which is deemed to cause degradation of the plating adhesion properties is reduced due to pH buffering of ammonium sulfate.

The polyoxyalkylene derivative is added to coprecipitate Cr, as described above, and its addition amount is defined to be 0.1 g/l or more. If the addition amount is less than 0.1 g/l, the effect of coprecipitating Cr is not sufficient, and a Zn—Cr plating film cannot be obtained. The Cr coprecipitation effect saturates when the polyoxyalkylene derivative is added in an amount exceeding 10 g/l. The addition amount of the polyoxyalkylene derivative is preferably 10 g/l or less in view of chemical cost.

The addition amount of ammonium sulfate must be changed depending on the Zn—Cr plating composition to be produced, in favor of good plating adhesion properties. The addition amount of ammonium sulfate preferably satisfy the following condition:

Addition Amount of Ammonium Sulfate $$(g/l) \geqq (Cr\% + M\% - 15) \times 10$$

where Cr % is the Cr content (wt %) in the plating film and M % is the content (wt %) of a metal except for Zn and Cr in the plating film.

According to this embodiment, a sulfuric acid plating bath is used for the same reason as in the first embodiment. The pH of this plating bath is defined to fall within the range of 1 to 3 for the same reason as in the first embodiment. Although the Cr coprecipitation rate increases at a higher current density, Cr coprecipitation can be performed at a general plating current density of 50 to 150 A/dm$^2$.

Examples of the Zn—Cr alloy are Zn—Cr, Zn—Fe—Cr, Zn—Ni—Cr, and Zn—Co—Cr alloys, and alloys obtained by adding Mo to the alloys as in the first embodiment.

EXAMPLES

Example 1

After cold-rolled steel sheets were degreased and pickled, they were subjected to plating using a plating bath composition under plating conditions as follows:

| Plating Bath Composition | |
|---|---|
| Zinc Sulfate: | 200 g/l |
| Chromium Sulfate: (20 g/l as chromium) | 200 g/l |
| Ammonium Sulfate: | 0 to 300 g/l |
| **Plating Conditions** | |
| Current Density: | 20 to 180 A/dm$^2$ |
| pH: | 2.0 |
| Plating Bath Temperature: | 50° C. |
| Plating Solution Flow Rate: | 2 m/sec |
| Plating Amount: | 30 g/m$^2$ |

The relationships between the Cr content in the Zn—Cr plating film and the addition amount of ammonium sulfate, and between the Cr content in the Zn—Cr plating film and the current density are shown in FIG. 1. As can be apparent from FIG. 1, when the addition amount of ammonium sulfate is less than 50 g/l, Cr hardly coprecipitates. However, when the addition amount of ammonium sulfate is 50 g/l or more, the Cr content sharply increases. The increase in Cr content becomes moderate after the sharp increase, and a precipitate is formed in the plating bath at an ammonium sulfate addition amount of 300 g/l. The plating efficiency is 90% or more in an ammonium sulfate addition amount range of less than 50 g/l where Cr hardly coprecipitates. When the Cr coprecipitation amount increases at an ammonium sulfate addition amount of 50 g/l or more, the plating efficiency sharply drops to about 80%, and then the decrease becomes moderate. The plating efficiency is about 65% at an ammonium sulfate addition amount of 300 g/l. At an ammonium sulfate addition amount of 50 to 250 g/l according to the present invention, the plating efficiency is 70% or more which is sufficient in practical applications.

Good plating adhesion properties can be obtained at an ammonium sulfate addition amount of 50 to 300 g/l. The outer appearance of the plating film is degraded upon addition of 300 g/l of ammonium sulfate. The plating adhesion properties were evaluated by peeled states in OT bending, and the evaluation standards are as follows:

○: good (no peeling is found)

Δ: relatively poor (peeling is found)

×: poor (peeling is frequent)

Figure 2:
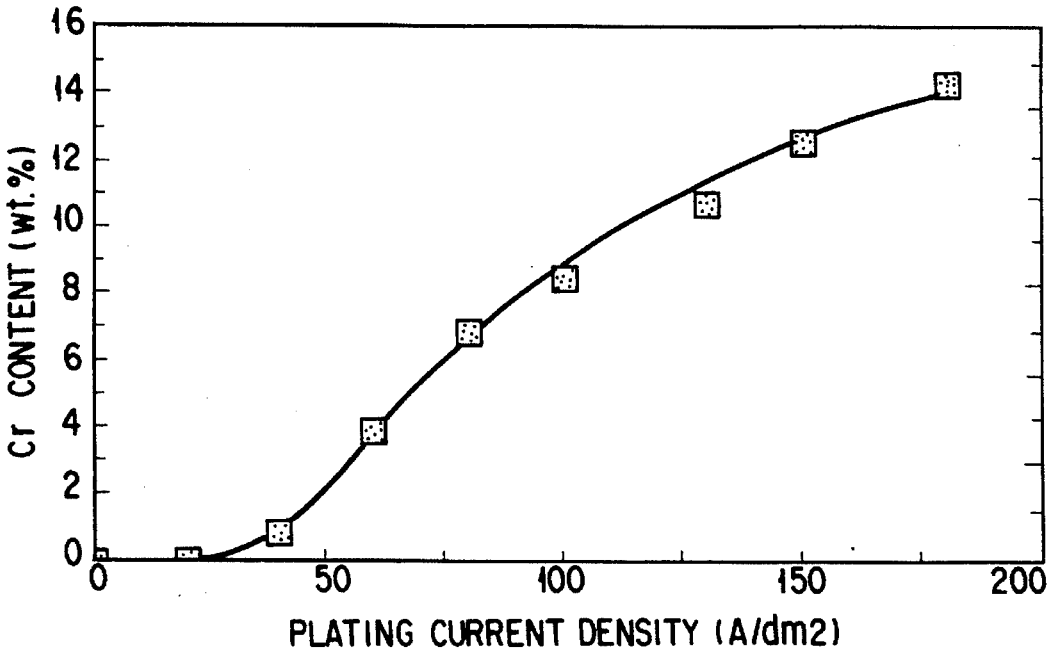
FIG. 2 is a graph showing the relationship between the plating current density and the Cr content of plating in Example 1.

FIG. 2 shows the influence of the current density on the Cr content. As can be apparent from FIG. 2, the Cr content greatly increases at a current density of 40 A/dm$^2$ or more. The increase in Cr content becomes moderate at a current density of 60 A/dm$^2$ or more. In any case, Zn—Cr plating can be performed and excellent plating adhesion properties can be obtained within a practical current density range of 50 to 150 A/dm$^2$.

Example 2

After cold-rolled steel sheets were degreased and pickled, they were subjected to plating using a plating bath composition under plating conditions as follows:

| Plating Bath Composition | |
|---|---|
| Zinc Sulfate: | 100 g/l |
| Ferrous Sulfate: | 100 g/l |
| Chromium Sulfate: (20 g/l as chromium) | 200 g/l |
| Ammonium Sulfate: | 0 to 300 g/l |
| **Plating Conditions** | |
| Current Density: | 20 to 180 A/dm$^2$ |
| pH: | 2.0 |
| Plating Bath Temperature: | 50° C. |
| Plating Solution Flow Rate: | 2 m/sec |
| Plating Amount: | 30 g/m$^2$ |

Figure 3:
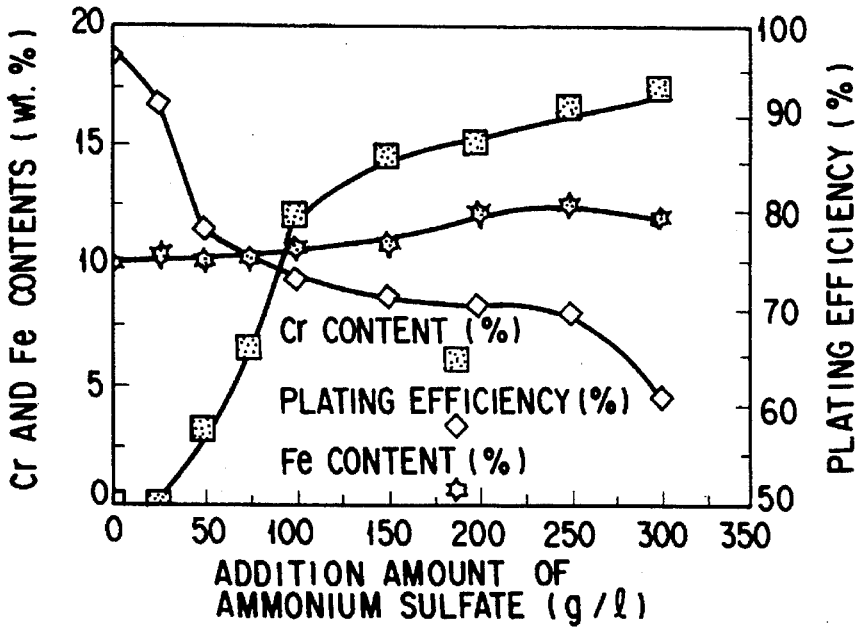
FIG. 3 is a graph showing the relationship between the addition amount of ammonium sulfate and the Cr and Fe contents in the plating film, and between the addition amount of ammonium sulfate and the plating efficiency in Example 2.

The relationships between the Cr and Fe contents in the Zn—Fe—Cr plating film and the addition amount of ammonium sulfate, and between Cr and Fe contents in the Zn—Fe—Cr plating film and the current density are shown in FIG. 3. As can be apparent from FIG. 3, the Cr content sharply increases at an ammonium sulfate addition amount of 50 g/l to 150 g/l. The increase in Cr content becomes moderate at 150 g/l or more. On the other hand, the Fe content hardly receives the influence of the addition amount of ammonium sulfate. The plating efficiency decreases with an increase in Cr content in the same manner as in Zn—Cr. The plating efficiency decreases to about 60% at an ammonium sulfate addition amount of 300 g/l. A plating efficiency of about 70% is maintained at an ammonium sulfate addition amount of 250 g/l. The plating adhesion properties are excellent at an ammonium sulfate addition amount of 50 g/l or more.

Figure 4:
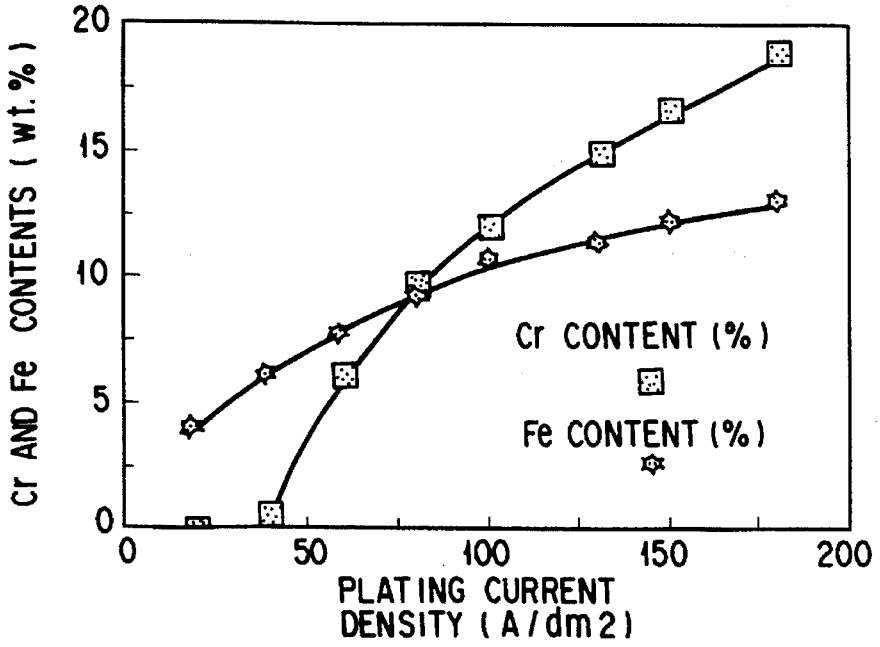
FIG. 4 is a graph showing the relationship between the plating current density and the Cr and Fe contents in the plating film in Example 2.

FIG. 4 shows the influence of the current density on the Cr and Fe contents. As can be apparent from FIG. 4, coprecipitation hardly occurs at a current density of 40 $A/dm^2$ or less, but the Cr content increases with an increase in current density at 60 $A/dm^2$ or more. The plating adhesion properties are excellent at all the contents.

In Example 2, the result of the Zn—Fe—Cr plating film is exemplified. However, almost the same results as in Zn—Fe—Cr, i.e., Cr coprecipitation and excellent plating adhesion properties at an ammonium sulfate addition amount of 50 g/l to 250 g/l, can be obtained in Zn—Ni—Cr and Zn—Co—Cr.

Example 3

After cold-rolled steel sheets were degreased and pickled, they were subjected to plating using plating bath compositions under plating conditions shown in Table 1 to obtain various Zn—Cr alloy plating films. The compositions of the resultant plating films and adhesion test results are also shown in Table 1.

TABLE 1

| | Plating Bath Composition (g/l) | | | |
|---|---|---|---|---|
| | Zinc Sulfate | Chromium Sulfate | Other Metal Sulfates Except for Left Components | Additives Except for Left Components |
| Example A | 200 | 200 | — | — |
| Example B | 200 | 200 | — | — |
| Example C | 100 | 100 | Ferrous sulfate 100 | — |
| Example D | 100 | 100 | Ferrous sulfate 100 | — |
| Example E | 100 | 100 | Ferrous sulfate 100 | — |
| Example F | 100 | 200 | Ferrous sulfate 100 | Sodium molybdate 25 |
| Example G | 100 | 300 | Ferrous sulfate 100 | — |
| Example H | 100 | 200 | Nickel sulfate 100 | — |
| Example I | 100 | 200 | Nickel sulfate 100 | Sodium molybdate 25 |
| Example J | 120 | 200 | Cobalt sulfate 120 | — |
| Comparative Example A | 200 | 200 | — | — |
| Comparative Example B | 200 | 200 | — | — |
| Comparative Example C | 100 | 100 | Ferrous sulfate 100 | — |
| Comparative Example D | 100 | 100 | Nickel sulfate 100 | — |
| Comparative Example E | 100 | 200 | Nickel sulfate 100 | — |
| Comparative Example F | 200 | 150 | — | Polyethylene glycol (m = 5000)[3] |
| Comparative Example G | 200 | 200 | Ferrous sulfate 100 | Polyethylene glycol (m = 5000)[3] |

| | Plating Condition | | | Plating Film Composition | | |
|---|---|---|---|---|---|---|
| | Ammonium sulfate | Current Density ($A/dm^2$) | pH | Cr Content (wt %) | Metals Except for Zn and Cr (wt %) | Plating Adhesion Properties |
| Example A | 150 | 100 | 1.2 | 4.2 | — | ○ |
| Example B | 150 | 100 | 2.8 | 12.2 | — | ○ |
| Example C | 150 | 50 | 2 | 1.9 | Fe 9.3 | ○ |
| Example D | 150 | 100 | 2 | 3.8 | Fe 11.1 | ○ |
| Example E | 150 | 150 | 2 | 5.2 | Fe 13.3 | ○ |
| Example F | 150 | 100 | 2 | 9.1 | Fe 10.8<br>Mo 2.1 | ○ |
| Example G | 150 | 100 | 2 | 12.6 | Fe 12.6 | ○ |
| Example H | 100 | 100 | 1.5 | 10.3 | Ni 11.1 | ○ |
| Example I | 100 | 100 | 1.5 | 9.2 | Ni 10.9<br>Mo 1.7 | ○ |
| Example J | 100 | 100 | 2 | 9.6 | Co 3.4 | ○ |
| Comparative Example A | 150 | 100 | 0.9 | 0.1 | — | ○ |
| Comparative Example B | 150 | 100 | 3.2 | 18.7 | — | x |
| Comparative Example C | 0 | 100 | 2 | 1.6 | Fe 15.6 | x |
| Comparative Example D | 0 | 100 | 1.5 | 1.1 | Ni 12.3 | x |
| Comparative Example E | 40 | 100 | 1.5 | 1.4 | Ni 12.1 | x |
| Comparative Example F | 0 | 100 | 2 | 15.3 | — | x |
| Comparative Example G | 0 | 100 | 2 | 12.0 | Fe 14.3 | x |

As can be apparent from Table 1, excellent plating adhesion properties were obtained in various Zn—Cr plating films in Examples A to J at various Cr contents.

On the other hand, in Comparative Example A, since the pH of the plating bath is less than 1, Cr hardly coprecipitates, and a Zn—Cr plating film is not formed. In Comparative Example B, the Cr content is high due to a pH of 3 or more, thereby obtaining a Zn—Cr plating film. However, the plating adhesion properties are degraded presumably due to the coprecipitation of Cr hydroxide. In Comparative Examples C to E, since ammonium sulfate is not added or is added only in small amounts, the Cr contents are small in the corresponding plating films, and the plating adhesion properties are poor.

Comparative Examples F and G exhibit results obtained when polyethylene glycol (molecular weight: 5,000) is added. Although polyethylene glycol has a Cr coprecipitation effect, the plating adhesion properties are poor.

Example 4

After cold-rolled steel sheets were degreased and pickled, they were subjected to plating using plating bath compositions under plating conditions as follows:

| Plating Bath Composition | |
|---|---|
| Zinc Sulfate: | 100 to 200 g/l |
| Ferrous Sulfate: | 0 to 200 g/l |
| Chromium Sulfate: | 300 g/l |
| Polyethylene Glycol: (molecular weight: 2,000) | 3 g/l |
| Ammonium Sulfate: | 0 to 150 g/l |
| **Plating Conditions** | |
| Current Density: | 50 to 150 A/dm$^2$ |
| pH: | 2.0 |
| Plating Bath Temperature: | 50° C. |
| Plating Amount: | 30 g/m$^2$ |

Figure 5:
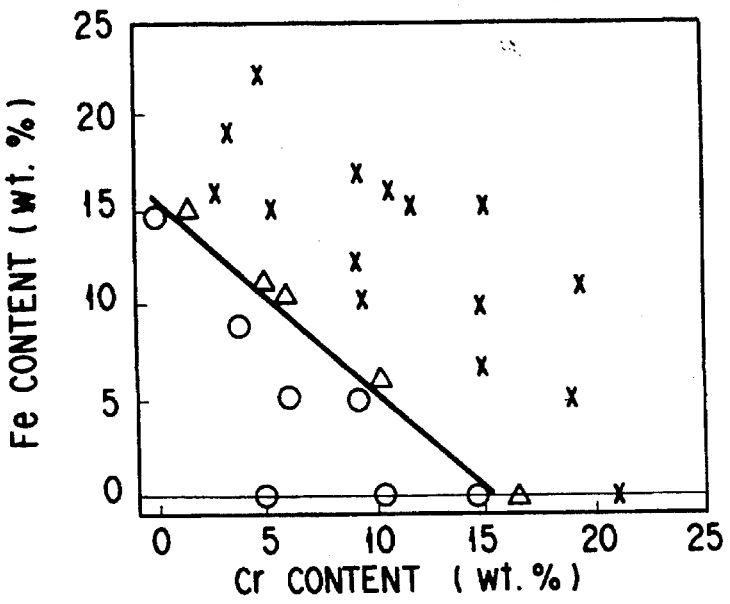
FIG. 5 is a graph showing the relationship between the Cr and Fe contents and the plating adhesion properties in Example 4 when ammonium sulfate is not added.
Figure 6:
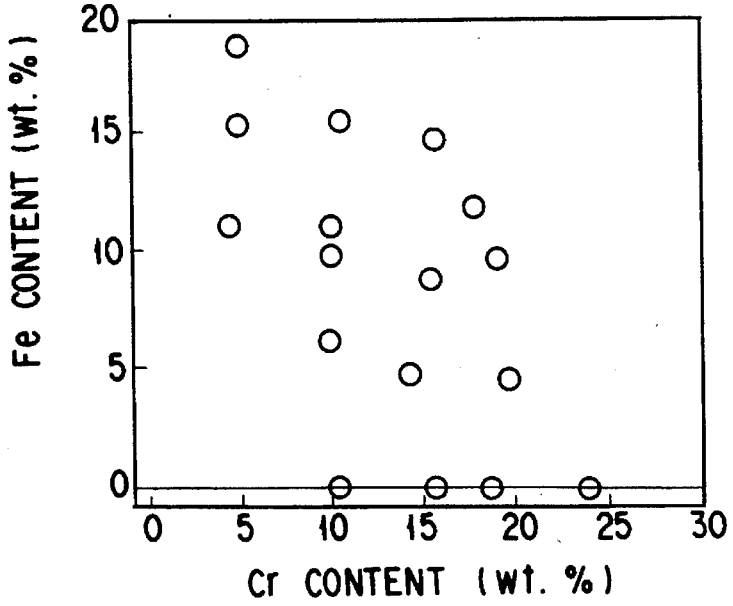
FIG. 6 is a graph showing the relationship between the Cr and Fe contents and the plating adhesion properties in Example 4 when 150 g/l of ammonium sulfate are added to the plating bath.

The relationships between the compositions of the Zn—Cr and Zn—Fe—Cr plating films and the plating adhesion properties when the addition amounts of ammonium sulfate are 0 g/l and 150 g/l are shown in FIGS. 5 and 6, respectively. The plating adhesion properties were evaluated by peeled states in 0T bending, and the evaluation standards are as follows:

○: good (no peeling is found)

Δ: relatively poor (peeling is found)

×: poor (peeling is frequent)

FIG. 5 shows a case wherein ammonium sulfate is not added. The plating adhesion properties of the Zn—Cr plating film are degraded more with an increase in Cr content. When the Cr content exceeds 15%, good plating adhesion properties cannot be obtained. The plating adhesion properties of the Zn—Fe—Cr plating film are degraded more with increases in Cr and Fe contents. When the sum of the Cr and Fe contents exceeds 15%, good plating adhesion properties cannot be obtained.

To the contrary, FIG. 6 shows a case in which 150 g/l of ammonium sulfate are added. Good plating adhesion properties are obtained for all the compositions shown in FIG. 6. The (Cr+Fe)% of each composition in FIG. 6 falls within 30%, and the addition amount of ammonium sulfate satisfies the following condition:

Addition Amount of Ammonium Sulfate $$(g/l) \geqq (Cr\% + Fe\% - 15) \times 10$$

That is, it is confirmed that excellent plating adhesion properties are obtained if the addition amount of ammonium sulfate falls within the range of the present invention.

Example 5

After cold-rolled steel sheets were degreased and pickled, they were subjected to plating using plating bath compositions under plating conditions shown in Tables 2 and 3. The compositions of the resultant plating films and the adhesion test results are also shown in Tables 2 and 3. Table 2 shows samples using polyethylene glycol as a polyoxylene derivative, and Table 4 shows samples using polyamine sulfonic acid as a polyoxylene derivative.

TABLE 2

| | Plating Bath Composition (g/l) | | | | | |
|---|---|---|---|---|---|---|
| | Zinc Sulfate | Chromium Sulfate | Other Metal Sulfates Except for Left Components | Additives Except for Left Components | Polyethylene Glycol | Ammonium Sulfate |
| Example K | 200 | 200 | — | — | 3.0 | 30 |
| Example L | 200 | 200 | — | — | 3.0 | 80 |
| Example M | 100 | 100 | Ferrous sulfate 100 | — | 3.0 | 80 |
| Example N | 100 | 100 | Ferrous sulfate 100 | — | 3.0 | 120 |
| Example O | 100 | 100 | Ferrous sulfate 100 | — | 3.0 | 120 |
| Example P | 100 | 100 | Ferrous sulfate 100 | Sodium molybdate 25 | 3.0 | 120 |
| Example Q | 100 | 200 | Ferrous sulfate 200 | — | 3.0 | 150 |
| Example R | 100 | 200 | Nickel sulfate 100 | — | 3.0 | 120 |
| Example S | 100 | 200 | Nickel sulfate 100 | Sodium molybdate 25 | 3.0 | 120 |
| Example T | 100 | 200 | Cobalt sulfate 120 | — | 3.0 | 50 |
| Example U | 100 | 200 | Cobalt sulfate 120 | Sodium molybdate 25 | 3.0 | 50 |
| Example V | 100 | 300 | — | — | 0.1 | 30 |
| Example W | 200 | 200 | — | — | 1.0 | 50 |
| Example X | 200 | 200 | — | — | 10.0 | 80 |
| Comparative Example H | 200 | 200 | — | — | 3.0 | 30 |
| Comparative Example I | 200 | 200 | — | — | 3.0 | 150 |
| Comparative Example J | 200 | 200 | — | — | 3.0 | 30 |

TABLE 2-continued

| | | | | | | |
|---|---|---|---|---|---|---|
| Comparative Example K | 100 | 100 | Ferrous sulfate 100 | — | 3.0 | 80 |
| Comparative Example L | 100 | 200 | Nickel sulfate 100 | — | 3.0 | 50 |
| Comparative Example M | 100 | 200 | Nickel sulfate 100 | Sodium molybdate 25 | 3.0 | 80 |
| Comparative Example N | 100 | 200 | Cobalt sulfate 120 | — | 3.0 | 0 |
| Comparative Example O | 100 | 200 | Cobalt sulfate 120 | Sodium molybdate 25 | 3.0 | 30 |

| | Plating Condition | | Plating Film Composition | | Addition Amount of | |
|---|---|---|---|---|---|---|
| | Current Density ($A/dm^2$) | pH | Cr Content (wt %) | Metals Excect for Zn and Cr (wt %) | Ammonium Sulfate (g/l) - (Cr % + M % − 15) × 10 | Plating Adhesion Properties |
| Example K | 150 | 1.2 | 16.6 | — | 14 | o |
| Example L | 100 | 2.8 | 22.7 | — | 3 | o |
| Example M | 100 | 2 | 8.1 | Fe 11.2 | 37 | o |
| Example N | 100 | 2 | 8.8 | Fe 12.3 | 59 | o |
| Example O | 150 | 2 | 13.0 | Fe 13.9 | 1 | o |
| Example P | 100 | 2 | 10.4 | Fe 11.8<br>Mo 2.0 | 28 | o |
| Example Q | 100 | 2 | 14.1 | Fe 15.5 | 4 | o |
| Example R | 100 | 1.5 | 12.3 | Ni 12.8 | 19 | o |
| Example S | 100 | 1.5 | 10.1 | Ni 11.2<br>Mo 1.9 | 38 | o |
| Example T | 100 | 2 | 14.6 | Co 3.3 | 21 | o |
| Example U | 100 | 2 | 14.1 | Co 3.2<br>Mo 2.0 | 7 | o |
| Example V | 150 | 2.8 | 16.7 | — | 13 | o |
| Example W | 100 | 2 | 19.3 | — | 7 | o |
| Example X | 100 | 2 | 21.3 | — | 17 | o |
| Comparative Example H | 150 | 0.9 | 0.1 | — | 29 | o |
| Comparative Example I | 150 | 3.2 | 23.2 | — | 68 | x |
| Comparative Example J | 100 | 2 | 18.9 | — | −9 | Δ |
| Comparative Example K | 100 | 2 | 12.7 | Fe 12.6 | −23 | x |
| Comparative Example L | 100 | 1.5 | 11.4 | Ni 12.0 | −34 | x |
| Comparative Example M | 100 | 1.5 | 11.0 | Ni 11.1<br>Mo 2.0 | −11 | Δ |
| Comparative Example N | 100 | 2 | 15.0 | Co 3.0 | −30 | x |
| Comparative Example O | 100 | 2 | 14.1 | Co 3.0<br>Mo 2.4 | −15 | x |

(Note) M: metal components except for Zn and Cr

TABLE 3

| | Plating Bath Composition (g/l) | | | | | |
|---|---|---|---|---|---|---|
| | Zinc Sulfate | Chromium Sulfate | Other Metal Sulfates Except for Left Components | Additives Except for Left Components | Polyamine Sulfonic Acid | Ammonium Sulfate |
| Example Y | 200 | 200 | — | — | 3.0 | 30 |
| Example Z | 200 | 200 | — | — | 3.0 | 80 |
| Example a | 100 | 100 | Ferrous sulfate 100 | — | 3.0 | 80 |
| Example b | 100 | 100 | Ferrous sulfate 100 | — | 3.0 | 120 |
| Example c | 100 | 100 | Ferrous sulfate 100 | — | 3.0 | 120 |
| Example d | 100 | 100 | Ferrous sulfate 100 | Sodium molybdate 25 | 3.0 | 120 |
| Example e | 100 | 200 | Ferrous sulfate 200 | — | 3.0 | 150 |
| Example f | 100 | 200 | Nickel sulfate 100 | — | 3.0 | 120 |
| Example g | 100 | 200 | Nickel sulfate 100 | Sodium molybdate 25 | 3.0 | 120 |
| Example h | 100 | 200 | Cobalt sulfate 120 | — | 3.0 | 50 |
| Example i | 100 | 200 | Cobalt sulfate 120 | Sodium molybdate 25 | 3.0 | 50 |
| Example j | 100 | 300 | — | — | 0.1 | 30 |
| Example k | 200 | 200 | — | — | 1.0 | 50 |
| Example l | 200 | 200 | — | — | 10.0 | 80 |

TABLE 3-continued

| | | | | | | |
|---|---|---|---|---|---|---|
| Comparative Example P | 200 | 200 | — | — | 3.0 | 30 |
| Comparative Example Q | 200 | 200 | — | — | 3.0 | 150 |
| Comparative Example R | 200 | 200 | — | — | 3.0 | 30 |
| Comparative Example S | 100 | 100 | Ferrous sulfate 100 | — | 3.0 | 80 |
| Comparative Example T | 100 | 200 | Nickel sulfate 100 | — | 3.0 | 50 |
| Comparative Example U | 100 | 200 | Nickel sulfate 100 | Sodium molybdate 25 | 3.0 | 80 |
| Comparative Example V | 100 | 200 | Cobalt sulfate 120 | — | 3.0 | 0 |
| Comparative Example W | 100 | 200 | Cobalt sulfate 120 | Sodium molybdate 25 | 3.0 | 30 |

| | Plating Condition | | Plating Film Composition | | Addition Amount of | |
|---|---|---|---|---|---|---|
| | Current Density ($A/dm^2$) | pH | Cr Content (wt %) | Metals Except for Zn and Cr (wt %) | Ammonium Sulfate (g/l) - (Cr % + M % − 15) × 10 | Plating Adhesion Properties |
| Example Y | 150 | 1.2 | 16.6 | — | 10 | o |
| Example Z | 100 | 2.8 | 20.3 | — | 27 | o |
| Example a | 100 | 2 | 7.7 | Fe 12.5 | 28 | o |
| Example b | 100 | 2 | 7.9 | Fe 13.5 | 56 | o |
| Example c | 150 | 2 | 12.2 | Fe 14.3 | 5 | o |
| Example d | 100 | 2 | 9.5 | Fe 12.1<br>Mo 1.9 | 35 | o |
| Example e | 100 | 2 | 13.2 | Fe 15.8 | 10 | o |
| Example f | 100 | 1.5 | 12.0 | Ni 12.9 | 21 | o |
| Example g | 100 | 1.5 | 10.3 | Ni 11.4<br>Mo 1.8 | 35 | o |
| Example h | 100 | 2 | 14.2 | Co 3.1 | 27 | o |
| Example i | 100 | 2 | 14.1 | Co 3.1<br>Mo 2.1 | 7 | o |
| Example j | 150 | 2.8 | 15.9 | — | 9 | o |
| Example k | 100 | 2 | 18.5 | — | 15 | o |
| Example l | 100 | 2 | 20.1 | — | 29 | o |
| Comparative Example P | 150 | 0.9 | 0.0 | — | 30 | o |
| Comparative Example Q | 150 | 3.2 | 21.9 | — | 81 | x |
| Comparative Example R | 100 | 2 | 18.2 | — | −2 | Δ |
| Comparative Example S | 100 | 2 | 11.7 | Fe 13.4 | −21 | x |
| Comparative Example T | 100 | 1.5 | 11.0 | Ni 11.6 | −26 | x |
| Comparative Example U | 100 | 1.5 | 10.3 | Ni 12.1<br>Mo 1.9 | −13 | Δ |
| Comparative Example V | 100 | 2 | 14.1 | Co 3.3 | −24 | x |
| Comparative Example W | 100 | 2 | 13.8 | Co 3.2<br>Mo 2.4 | −14 | x |

(Note) M: metal components except for Zn and Cr

As shown in Tables 2 and 3, excellent plating adhesion properties were obtained in various Zn—Cr plating films in Examples K to l. The addition amounts of ammonium sulfate in Examples K to Z are larger than (Content of Metal Component Except for Zinc-15)×10 and are found to fall within the range of the present invention. The contents of a polyoxylene derivative are 0.1 g/l or more, which fall within the range of the present invention.

On the other hand, in Comparative Examples H and P, since the pH of the plating solution is less than 1, Cr hardly coprecipitates, and no Zn—Cr plating films are obtained. In Comparative Examples I and Q, since the pH exceeds 3, the Cr content is high to obtain a Zn—Cr plating film. However, the plating adhesion properties are degraded presumably by coprecipitation of Cr hydroxide. No effect of ammonium sulfate can be obtained at this pH. In Comparative Examples J to O and R to W, various Zn—Cr plating films are obtained, but the plating adhesion properties are poor due to insufficient amounts of ammonium sulfate.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a plated steel sheet with a Zn—Cr alloy plating film, comprising the steps of preparing a plating bath having a pH of 1 to 3 by adding to a sulfuric acid Zn—Cr electroplating bath containing $Zn^{2+}$ and $Cr^{3+}$ not less than 0.1 g/l nor more than 10 g/l of a polyoxyalkylene derivative and ammonium sulfate in an amount of 50 to 250 g/l and further represented by the following formula:

$$\text{ammonium sulfate (g/l)} \geqq (Cr\% + M\% - 15) \times 10$$

where Cr% is a Cr content (wt %) in the plating film and M% is a content (wt %) of a metal except for Zn and Cr in the plating film; and electroplating a Zr—Cr film onto a steel sheet using said plating bath.

2. A method according to claim 1, wherein the Zn—Cr alloy plating film is formed by an alloy selected from the group consisting of Zn—Cr, Zn—Fe—Cr, Zn—Ni—Cr, and Zn—Co—Cr alloys, and alloys obtained by adding Mo to the alloys.

* * * * *